US010370888B2

(12) United States Patent
Harding et al.

(10) Patent No.: US 10,370,888 B2
(45) Date of Patent: Aug. 6, 2019

(54) DOOR SYSTEM WITH SENSOR UNIT AND COMMUNICATION ELEMENT

(71) Applicant: Gebr. Bode GmbH & Co. KG, Kassel (DE)

(72) Inventors: Alfons Harding, Borchen (DE); Benjamin Scheffer, Kassel (DE)

(73) Assignee: GEBR. BODE GMBH & CO. KG, Kassel (DE)

( * ) Notice: Subject to any disclaimer, the term of this patent is extended or adjusted under 35 U.S.C. 154(b) by 98 days.

(21) Appl. No.: 15/512,665

(22) PCT Filed: Sep. 21, 2015

(86) PCT No.: PCT/EP2015/071581

§ 371 (c)(1),
(2) Date: Mar. 20, 2017

(87) PCT Pub. No.: WO2016/042168

PCT Pub. Date: Mar. 24, 2016

(65) Prior Publication Data

US 2017/0306685 A1 Oct. 26, 2017

(30) Foreign Application Priority Data

Sep. 19, 2014 (DE) ..... 10 2014 113 569

(51) Int. Cl.

| | |
|---|---|
| ***E05F 15/73*** | (2015.01) |
| ***B61D 19/00*** | (2006.01) |
| ***B61L 15/00*** | (2006.01) |
| ***E05F 15/00*** | (2015.01) |

(Continued)

(52) U.S. Cl.
CPC ..... *E05F 15/73* (2015.01); *B61D 19/00* (2013.01); *B61L 15/0081* (2013.01);
(Continued)

(58) Field of Classification Search
CPC combination set(s) only.
See application file for complete search history.

(56) References Cited

U.S. PATENT DOCUMENTS 5,148,410 A * 9/1992 Kuhn ..... G01S 15/04 367/96
5,176,082 A * 1/1993 Chun ..... B61B 1/02 104/28

(Continued)

FOREIGN PATENT DOCUMENTS

EP 1619469 A1 1/2006
FR 2734644 A1 11/1996

(Continued)

OTHER PUBLICATIONS

"Safety Sensor for External Railway Doors", Oct. 1, 2011, pp. 3, 5, 7, 9, and 11 XP05523645, URL:http://www.sensorio.be/uploads/docs/manuals/ug_lzr-rs30_en_v3.pdf.

(Continued)

*Primary Examiner* — Travis R Hunnings
(74) *Attorney, Agent, or Firm* — Cantor Colburn LLP

(57) ABSTRACT

A door system for a public transit vehicle with at least one door opening and a door that closes this door opening includes a sensor unit, which does three-dimensional and touch-free scanning of a passenger compartment in the area of the door opening and at least one communication element for the context-based communication with passengers based on readings by the sensor unit. A process for monitoring and controlling door systems of a public transit vehicle are also provided including the steps of touch-free and three-dimensional scanning of a passenger compartment in the area of a door opening with a sensor unit and measuring distances, shapes, and movements of objects by evaluating the readings of the touch-free and three-dimensional scanning. The process also includes issuing context-based information to (Continued)

affected passengers via a communications system, whereby the information is based on readings from the sensor unit. A process for monitoring and controlling such a door system.

20 Claims, 2 Drawing Sheets

(51) Int. Cl.
*E05F 15/43* (2015.01)
*G07C 9/00* (2006.01)

(52) U.S. Cl.
CPC ..... *E05F 15/00* (2013.01); *E05F 15/43* (2015.01); *G07C 9/00007* (2013.01); *E05F 2015/765* (2015.01); *E05Y 2400/40* (2013.01); *E05Y 2400/44* (2013.01); *E05Y 2400/45* (2013.01); *E05Y 2400/54* (2013.01); *E05Y 2400/852* (2013.01); *E05Y 2400/86* (2013.01); *E05Y 2900/50* (2013.01)

(56) References Cited

U.S. PATENT DOCUMENTS 5,986,561 A 11/1999 Kuruvilla et al.
6,341,563 B1 * 1/2002 Gal ..... B61D 19/026 104/28
7,893,811 B2 * 2/2011 Augustyniak ..... G07C 9/025 177/25.13
2002/0036259 A1 3/2002 Agam et al.
2013/0125468 A1 5/2013 El Fassi et al.
2017/0292314 A1 * 10/2017 Scheffer ..... B61D 19/00

FOREIGN PATENT DOCUMENTS

JP 2005171573 A 6/2005
WO 0244505 A1 6/2002

OTHER PUBLICATIONS

"Sensing Success" Railway Strategies, Feb. 17, 2014, whole document; XP055236551, URL:http://www.railwaystrategies.co.uk/article-page.php?contentid=19393&issueid=547.
Bea Industrial: BEA Sensorio—Actualités—Infos récentes—The Stadler GTW train platforms equippped with LZR—RS300:, Sep. 15, 2010, whole document, URL:http://www.sensorio.be/fr/news/latests-news /LZR-RS300-stadler-gwt-train-platform/.
International Search Report dated Jan. 5, 2016 re: Application No. PCT/EP2015/07158, pp. 1-4, US 6 341 563 B1, EP 1 619 469 A1, US 2013/125468 A1, US 5 986 561 A, FR 2 734 644 A1, JP 2005 171573 A, WO 02/44505 A1, US 2002/036259 A1, "Bea Sensorio . . . ", Sensing Success, "Safety Sensor . . . ".

* cited by examiner

DOOR SYSTEM WITH SENSOR UNIT AND COMMUNICATION ELEMENT

TECHNICAL FIELD

The present disclosure relates to a door system for a public transit vehicle with at least one door opening and a door that closes the door opening. Furthermore, the application relates to a process for monitoring and controlling such a door system.

BACKGROUND

Door systems are used in particular in rail and road vehicles, but also in boats and on aeroplanes. Such door systems are monitored in many respects and controlled depending on a large variety of conditions. On the one hand, the safety of boarding and de-boarding passengers must always be safeguarded, on the other hand, doors and door wings must open and close reliably and only under certain circumstances. It must also be prevented that persons or objects are trapped between two door wings or between a door wing and a door frame.

In addition, the process of boarding and de-boarding is often delayed when passengers or objects are blocking the opening and closing of doors.

In accordance with the disclosure, the term door systems also includes boarding aids such as sliding treads and tread steps. Their function must also be monitored and controlled, since they may hold obstacles posing a danger for passengers. It must also be ensured that no persons or objects are trapped between a boarding aid and the platform and that the boarding aid does not bump against persons.

For these numerous monitoring and control tasks, a variety of sensor means are used in door systems, such as:

1. Various push buttons for operating the door.
2. Push bars/switch rails for recognizing obstacles. These are mostly installed in a main closing edge, either alone or also additionally in secondary closing edges inside the doors or door wings.
3. Light barriers inside the vehicle to hold open doors being used (for controlling automatically closing doors).
4. Step sensors (safety mats, strain gauges or such) to recognize loads on treads and boarding aids.
5. Power bars on step systems to recognize collisions with the platform or with passengers when steps are being extended.
6. Ultrasound sensors in step systems for measuring the distance to the platform and also the platform height.

The above named sensor systems require numerous components, sophisticated cabling and careful maintenance and upkeep. It is therefore necessary but also relatively expensive to completely monitor and satisfactorily control a door system.

SUMMARY

The disclosure provides a door system in which the above named monitoring and control tasks can be performed reasonably economically. Installation, maintenance and upkeep are to be as simple and low-cost as possible. In particular, the number of necessary components is to be reduced. The disclosure also provides that the door system is suitable for optimizing the boarding and de-boarding processes and the early prevention of dangers to passengers.

The disclosure also prepares an appropriate process for monitoring and controlling such a door system.

According to the disclosure, these advantages are achieved by providing a door system comprising a sensor unit which scans a passenger compartment in the vicinity of the door opening in three dimensions and touch-free, and with at least one communication element for the context-based communication with passengers based on the readings from the sensor unit.

The advantages are also achieved by providing a process comprises the following process steps:

- Touch-free and three-dimensional scanning of a passenger compartment in the vicinity of the doorway (44) with a sensor unit (26),
- Determining distances, shapes and movements of objects by evaluating the readings from touch-free and three-dimensional scanning, and
- Providing the affected passengers with context-based information over a communication means, whereby the information is based on the readings from the sensor unit (26).

Accordingly, the passenger compartment or boarding space is covered or scanned in three dimensions by means of a sensor unit inside and/or outside the vehicle. This three-dimensional scanning can be performed on the basis of known optical systems such as infrared sensors, infrared laser scanners, or suitable camera systems with optical image analysis; ultrasound scanning is also a possible alternative. The collected data can be used to test possible collisions between door systems and step systems and their surroundings or with passengers. Previously defined points in the space can be used as virtual buttons for controlling the door and step systems.

Thus, a substantial aspect of the disclosure is that the context-based information according to the disclosure is given directly to the affected users. Information is also given where it is needed, for example at a certain door and to a certain passenger. This ensures that passengers in question know that they are being directly addressed because the information is not given out in general terms at all the doors. In particular, the context-based communication is advantageous when a certain risk potential was recognized by the sensors. For example, if there is snow on a sliding step or if there is a gap between the step and the platform, those passengers are informed according to the disclosure who are in the area of the door that is affected by the risk. Communication can take the form of an announcement or a message on a display at the particular door. The communication can be announced by the driver who has previously been made aware of the problem by the system, or the disclosure also allows for an automated announcement or message in the area of the respective door.

Thus, the sensor unit determines a certain relevant condition or respective data, passing them to a computer unit, which then issues a context-based locally relevant information.

The term "context-relevant information" means that it is not automated and not issued generally everywhere, but that it is based on the data determined by the sensor unit and is specifically adapted to the local circumstances. On the one hand, the inventive context-based information includes the factual content of the information such as a specific danger at a specific location or in a specific place, on the other hand, the context decides what passengers are affected and are to be receiving the information. The information indicates at which door or doors it is relevant and is being issued. Thus, communication does not take place simultaneously at all the doors.

Below, the disclosure is being described substantially as an example for how the laser scanner unit is being used. However, instead of the laser scanner unit, the above named alternative sensor units can be used as well. In particular, in the case of explanations relating to spatial conditions and an evaluation of the scanner results, the type of sensor really does not matter, and in such a case, the term laser scanner unit can be regarded as a synonym for all suitable sensors.

In a particularly advantageous embodiment, the sensor unit is formed by a laser scanner unit placed in the area of the door opening. The laser scanner unit generates a kind of point cloud via which the passenger compartment is scanned in all three dimensions, i.e. in directions x, y and z. Preferably, the laser scanner unit uses infrared light which is invisible to the human eye. With the help of the transmitted point cloud, a distance measurement is conducted based on the so-called time-of-flight (ToF) principle. It means that the laser scanner emits light pulses and measures the delay until the reflection of the respective light pulse arrives. Via the measured delay of the reflection, the distance between the scanned point and the sensor unit can be estimated. The more scans there are taken per time unit, the more accurate the measured distance or the monitoring of the passenger compartment will be.

The resolution of the scan should be great enough to accurately recognize even the smallest objects that are to be detected. For analyzing the results, the sensor unit contains an evaluation unit with a computer/processor and the appropriate software. As an alternative, the evaluation unit can also be arranged externally of the sensor unit, for example in the driver compartment of a train.

The sensor unit should be placed such that the passenger compartment can be optimally scanned and that no unwanted elements protrude into the scanner rays. While these could be ignored by the sensor unit, they are creating a shadow. In case of two-wing doors, the middle position above the two door wings, i.e. in the area where the main closing edges butt together, has proven to be particularly advantageous. From this raised position, the point cloud is radiated downward.

According to the disclosure, it is particularly advantageous to install the point cloud in the middle above the door, since this allows the passenger compartment to be optimally scanned. With two-wing doors in the inner space, an arrangement next to and above the door has proven to be particularly advantageous because with a central placement, the carrying arms of the door would limit the view of the laser scanner.

According to the disclosure, it is possible to use the inventive sensor unit to produce virtual buttons. This means that it can be defined anywhere in the area where for example a hand movement of a passenger can be interpreted as the push of a button. If for example, the hand of a passenger at the position of the virtual button moves in the direction of an adhesive sticker or a marking on or next to the door of a double-door wing, the sensor unit would recognize this and release an opening or closing signal for the doors.

When such a virtual button is calibrated, an object is held against the point cloud at the desired place where the virtual button is to be generated. If this object is held still long enough, and if only this one object is recognized by the scanner, the object's midpoint is determined whose position is then used as the midpoint for the virtual button. Since with this calibration, the speed of elements is also measured, objects that are too fast are not accepted in this area. In another step, a radius is defined around this midpoint, which allows the size of the virtual button to be determined. When this virtual button is activated, the distance between all scanned objects recognized inside the passenger compartment and the midpoint of the virtual button are determined. If the distance between an object such as the hand of a passenger and the midpoint of the virtual button is smaller than the predetermined radius, the virtual scanner is considered activated. Preferably, for recognizing and activating, that area of the point cloud is used which is closest to the door opening. This has the effect that only movements can be recognized which extend very close to the wall of the door or to the vehicle wall. Ideally, the passengers must touch the sticker or the marking to activate the button.

The considerable advantage of such virtual buttons includes the fact that they can be positioned and installed anywhere. No additional cabling is necessary, and changes can be made anytime to the vehicle or to the position. It is also possible without a problem and with very insignificant additional costs to place several buttons in one door system. For example, it would be feasible to place additional buttons for children or wheelchair users.

When the sensor unit and the sensor surroundings are calibrated, the entire surroundings visible by the laser unit or the laser scanner are scanned and stored taking the tolerances into consideration. In addition, the dimensions of the door portal are integrated into the calibration to be able to exclude relevant objects beyond the door such as different platform heights or to adapt to possible obstacles. The sensor unit recognizes additional objects or elements inside the monitored passenger compartment without a problem.

For example, the sensor unit is coupled to the door or door wing and able to read the actual door or door wing position. The information is used to monitor the space between the door wings, and the surroundings can be ignored in this application. If there is only one door, the area immediately inside the door frame or the gap between the main closing edge and the door frame is being monitored.

According to the disclosure, it is also possible to monitor the space between the door wings, independently from the control of the door or door wing or the derived door position or door wing position, exclusively with the help of the sensor unit.

It has been found that according to the disclosure—especially when the data from the control of the door or door wing are used—an area in front of the door opening should also be scanned. This is necessary because the reading from the door position or door wing position based on the door control is often imprecise and subject to error. There can be deviation between the position given by the encoder of the door's drive motor and the real position of the main closing edges of the door wings. In addition, a deformation of the door rubber in the area of the main closing edge can leave a gap large enough for small objects such as dog leashes or even fingers, and these gaps are not monitored. Gaps are only monitored when the area immediately in front of them, i.e. in front of the door or the door wings is scanned. This point cloud in front of the door opening preferably overlaps with the door wings.

However, the substantial aspect of the disclosure also entails that communication with passengers is always possible. The sensor unit uses the readings not only to control the doors, but experience has shown that the readings can also be used for direct communication with passengers. For example, passengers can be asked to change their position, go to another car or to another vehicle, or to remove objects from dangerous areas. Such instructions to passengers can be given automatically by the door system itself or they can be given by a driver of the vehicle or an external control centre. In the former case, an information is generated automatically when certain readings are available. For example, if a person stands in the closing and opening part of a door or a door wing, according to the disclosure, an information, for example in the form of a message over the speaker system, can be given, asking the person to leave that dangerous area, Particularly suitable communication elements are speakers, monitors or lights. There may be only a single communication element, but alternatively, several different elements can be used at the same time. In a particularly simple version, a light can signal with the colours of red and green whether a door is being opened or not. In case of more extensive information, speakers or monitors may be better suited. The communication elements are preferably placed directly in the area of the door opening.

In a further development of the disclosure, it is taken into account that the virtual button—especially at busy stations—can become obscured by large objects and therefore cannot be used. The sensor unit takes that into account, and according to the disclosure, it will give the warning via the communication element. Such a warning may address the immediately affected passenger directly at the respective door, for example by speaker, or it may first be given to the driver or conductor who may then relay it to the passenger.

To avoid that passengers standing in front of the vehicle are injured by opening doors or door wings, the disclosure provides that the relevant area within range of the moving door is also monitored by the sensor unit. If objects are detected within this range, a signal is generated that can, for example, be used to stop or reverse the door or door wing. Advantageously it is also possible to generate a signal before the door opens that could be used to warn the passengers. In particular, this signal may be used to inform just those passengers who are affected. For example, a speaker announcement can be given at the door that is being stopped or reversed. There would be no announcements or signals at the other doors.

The inventive door system and process can also be used to recognize extremities and their position and speed. By using one or more point clouds, the speed of a movement in the direction of the door opening or away from the door opening can be detected. These data serve to draw conclusions about the intention of a passenger, for example an intention to open a door or to gain access.

According to the disclosure, it is even possible to detect and utilize the flow of passenger movement in the area of the doors. In practice, it is often customary to use certain doors either only for de-boarding or only for boarding. By recognizing a passenger's movement direction, a door can be blocked or opened to move the passenger flow in a certain direction. If for example, a passenger in the permitted movement direction has passed the door, and another passenger follows, the door can be closed directly to make it difficult for passengers to pass the door in the opposite direction. If a passenger moves toward this door in the wrong direction, this door can be closed more quickly to prevent its use in the wrong direction, provided that no one stands in the vicinity of the moving door or wishes to de-board. Preferably, a space in front of the door opening is also monitored with this kind of application, and this space can, for example, extend up to 10 m, preferably 2 to 5 m from the door in the direction of the platform or street. Thus, passengers are recognized early, and an early reaction is possible.

It is possible to inform passengers standing in the access area of individual doors that these doors will shortly be closed. That information is given only at the doors in front of which the passengers are situated.

Scanning the passenger compartment makes it possible to provide passengers with context-based information or to warn them of potential danger. For example, if a passenger leans against a door or door wing from the inside while it is to be opened, this passenger can be warned ahead of time. The same applies to an obstructing object leaned against the door. The door can remain locked until the potential danger is removed. In this case, too, specific information can be given to the passengers in the area of that door.

A similar case applies when a passenger obscures a virtual button. In that case, the passenger can be instructed via speaker or monitor or other signal to change position to allow the button to be used again. In this case, too, specific information can be given to the passengers in the area of that door while no announcement is given at the other doors.

Even when a passenger or an object is too close outside an opening door, a warning can be given, and the door opening can be held back until the area is free of obstacles. Advantageously, persons can be spotted who are standing on a boarding aid such that its retraction can be prevented or stopped. Accordingly, such passengers are asked to change their position.

A considerable advantage in the above named application is that a passenger must not have contact with a moving door before its opening or closing process is interrupted and/or reversed. With prior-art sensors, which are connected to the main closing edge, the passenger must have touched or even pushed in the closing edge or even pushed in the main closing edge before a signal is generated. Such a contact is often perceived as unpleasant and can also soil a passenger's clothes. These disadvantages are effectively avoided due to the touch-free scanning of the relevant passenger compartment.

The inventive embodiment of the door system or the inventive process of monitoring the passenger compartment allow further advantageous monitoring and control possibilities. For example, if a door is marked "defective" and a passenger approaches this door, the passenger can be advised about the status of the door via the communication means such as the speaker system. This is an advantage because it is known that passengers often disregard notices of defects in the form of stickers or only notice them when they see that the door does not function. Traffic can be speeded up and made easier when passengers who prevent a door from closing because they are standing too close are asked to stand back even before the door closes. With prior-art sensor systems, passengers are asked by the driver of the vehicle only when the driver notices the door's malfunctioning, for example, when it cannot be closed. Such situations are avoided when the position of passengers is recognized beforehand.

According to the disclosure, it is even possible to recognize a bicycle next to a passenger and to examine directly whether a place is available for it near the entrance selected by the passenger. The passenger can be informed accordingly via the communication system, for example given an indication that he should perhaps try an alternative entrance door.

It is also possible to inform boarding passengers as to the degree of crowding and especially the availability of seats in a certain car, and to tell them via the communication system in which car seats are still available.

In principle, it is possible with the inventive door system and the inventive process to inform the driver of the vehicle about the movement and use of doors, to allow for their optimal control. In particular, unused doors can be closed earlier or automatic doors can be released earlier where passengers are waiting to de-board. In heated or air-conditioned cars, it is an advantage when doors can be closed as early as possible. With prior-art systems, drivers can only control passengers on a platform or at a stop when they look in the rear-view mirror, thus depending on the driver's concentration and ability to pay attention.

According to the disclosure, three-dimensional scanning outside the vehicle can be used to recognize and report a layer of snow that has formed, for example, on a tread. Via the communication system, passengers can be directly informed accordingly about such a risk.

According to the disclosure, it is also possible to determine the distance between the door opening and the platform and therefore to optimally fold out the tread or boarding aid. This is a particular advantage when this distance varies from one station to another. This can eliminate the need for sensors on the boarding aids themselves. If for example a gap remains between the boarding aid and the platform although the sliding tread has been completely folded out, passengers can be made aware of this directly via the communication elements. This information, too, can be provided automatically by the system itself if appropriate readings are available.

By using three-dimensional scanning, not only the speed but also the number of passing passengers can be determined, and the number of passengers can be counted without a problem.

With the aid of appropriate algorithms, the shape and movement of passengers and objects can be approximated. Thus, objects such as suitcases can be differentiated from passengers. These data can be utilized to provide passengers with exact and easily understandable information via the communication system.

BRIEF DESCRIPTION OF THE DRAWINGS

The inventive door system will be described in detail with reference to the following figures. These are to be understood only as first embodiments, and the disclosure is not limited to these. The drawings are not to scale, where.

DETAILED DESCRIPTION OF THE DRAWINGS

Figure 1:
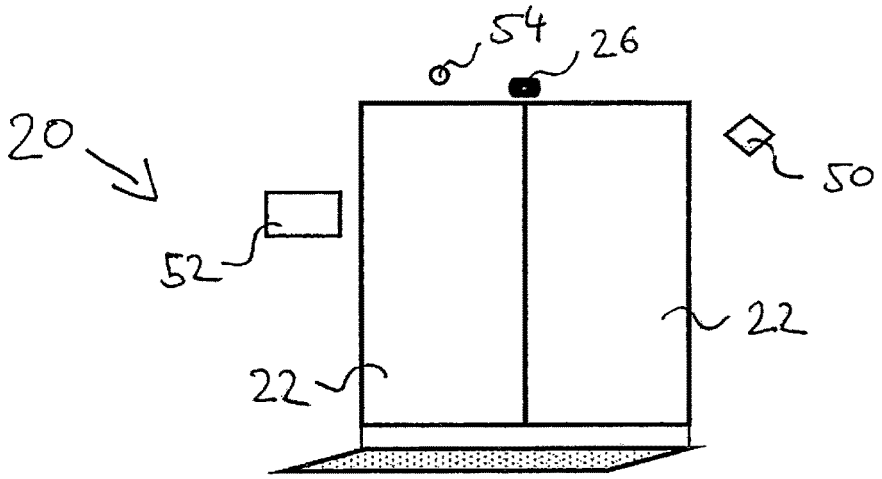
FIG. 1: An inventive door system from the outside is shown as a simplified schematic view.
Figure 2:
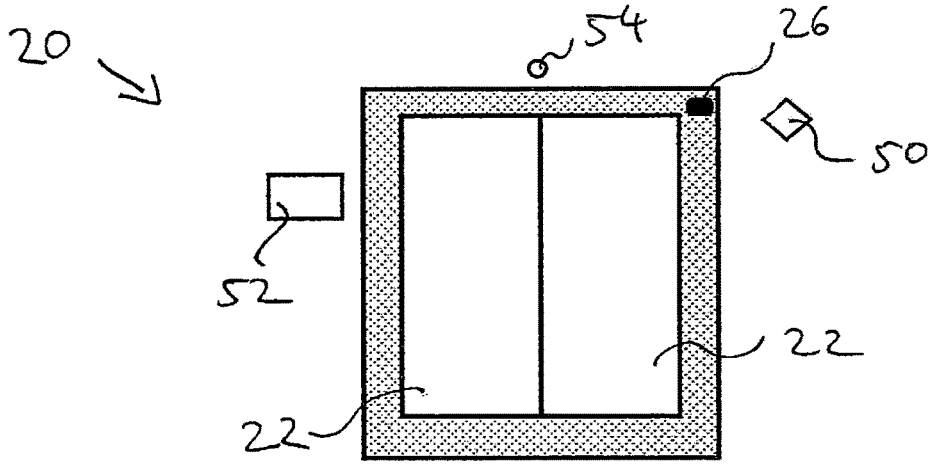
FIG. 2: An inventive door system from the inside is shown as a simplified schematic view.

FIGS. 1 and 2 show a greatly simplified schematic view of door system 20 for a public transit vehicle 42 (see FIG. 5). It comprises a door opening 44 not shown in FIGS. 1 and 2, which in the embodiment shown can be closed by a door with two wings 22. Below the door, a boarding aid 24 is installed which is to help passengers to board and de-board the vehicle. For example, this boarding aid 24 can be designed as a foldout tread step or tread plate.

Both figures also show a sensor unit 26. This is placed on the outside of vehicle 42 in the middle above door wings 22. On the inside of vehicle 42, the sensor unit 26 is positioned laterally above the two door wings 22, since otherwise the carrier arms (not shown) might limit the view of sensor unit 26. In principle, the sensor unit 26 can be placed in any suitable position, depending on the type of sensor.

The sensor unit 26 generates a point cloud inside the passenger compartment to be monitored, via which the passenger compartment is scanned. For this, the sensor unit 26 can for example comprise an optical sensor, preferably a laser, in particular an infrared laser.

Furthermore, the sensor unit 26 comprises an evaluation unit (not shown) to evaluate the readings. This unit can be integrated in the sensor unit or placed externally.

Furthermore, FIGS. 1 and 2 symbolically show different varieties of communication means, namely a speaker 50, a monitor 52 and a light 54, all placed in the area of the door opening 44.

Figure 3:
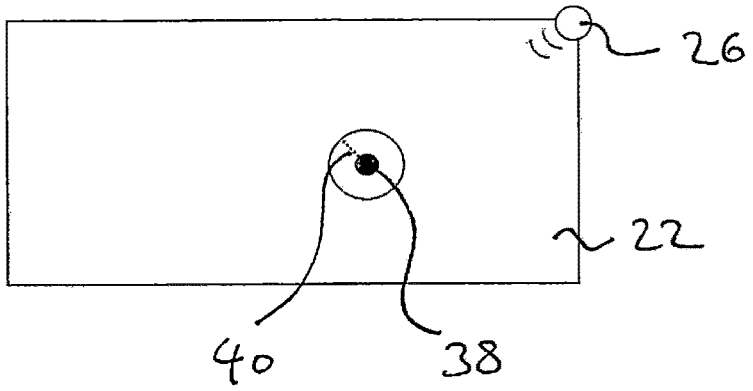
FIG. 3: A schematic sketch shows the function of a virtual button.

FIG. 3 shows the use of the inventive door systems 20 to create a virtual button 36. A virtual button 36 simulates a real button that would be wired. To tell passengers where this virtual button 36 is placed, an adhesive sticker or a painted symbol may indicate the location in the door area.

When such a virtual button 36 is calibrated or placed, an object is held against the point cloud in the desired position of the virtual button 36. If it is held still long enough, its position can be used as midpoint 38 for the virtual button 36. In addition, a radius 40 is determined and entered in the associated evaluation software. If for example a hand of a passenger approaches the virtual button 36 through the point cloud within the defined radius 40, this movement is interpreted as the passenger's intention to push it. However, alternatively to the passenger's hand, any object in this area is accordingly recognized and taken into account.

Figure 4:
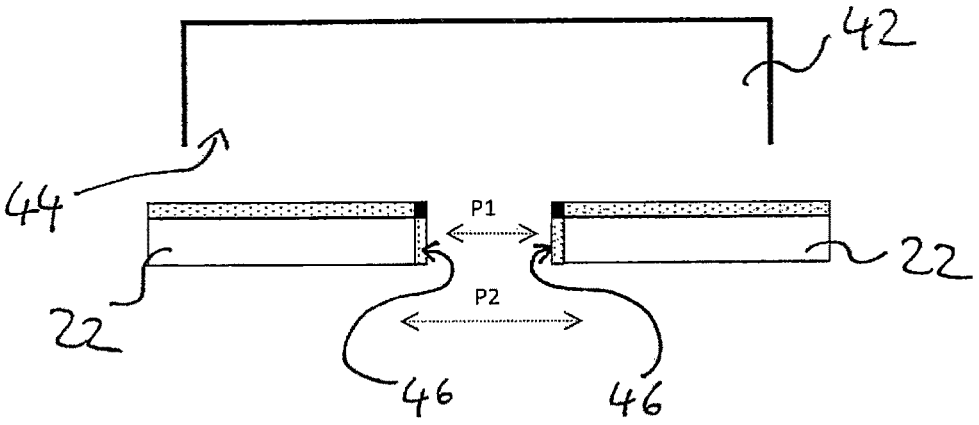
FIG. 4: A schematic sketch shows the monitoring of obstacles between two door wings.

FIG. 4 shows another example of using the inventive door system 20. Shown is an implied vehicle 42 with a door opening 44. In front of it are two door wings 22 in slightly opened position. A first point cloud area P1 monitors a space between the two door wings 22 and is limited to these, ignoring the other surroundings. A second point cloud area P2 scans the space immediately in front of the door wings 22 and is somewhat wider, thus overlapping the expanse of the door wings 22. If there is an obstacle in the monitored or scanned spaces, it is securely recognized, and the closing or movement of the door can be interrupted; or the door may be automatically reversed. The point cloud area P1 thus monitors a space between the main closing edges 46 of the two door wings 22. For a single door, the same principle can be used; in that case, the space between the main closing edge 46 of the only door and the door frame is monitored.

The disclosure is not limited to the described and depicted embodiments; instead, other applications of the inventive door system 20 are possible. For example, instead of a laser scanner, optical imaging can be used for monitoring, in which case an appropriate evaluation software evaluates movement, shape and speed.

For example, the use of a video camera is possible with a respective evaluation program. Communication with passengers is possible not only via a speaker system, but also via monitors or other optical signals such as warning lights. Of course, instead of door openings 44, passages or windows can also be monitored by means of the described process. The disclosure is also suitable in conjunction with other sensor elements such as ultrasound sensors. Furthermore, the sensor unit 26 can be designed and oriented such that not only the passenger compartment is monitored in the area of the door opening, but also for example a clearly larger area can be included for monitoring on the outside of the vehicle 42. This facilitates the early recognition of crowds and their direction, and to react to them by opening or closing doors. The passenger compartment can be monitored only on the outside, only on the inside, and preferable on both sides of the door.

It can also be provided according to the disclosure that the sensor unit 26 or the assigned evaluation unit is in connection with an external display. For example, this can be placed with the driver or at a control centre, preferable at a station or near a stop where the results generated by the sensor unit 26 can be evaluated and further processed.

The invention claimed is:

1. A door system for a public transit vehicle with at least one door opening and a door that closes the door opening, the door system comprising:

a sensor unit for three-dimensional and touch-free scanning of a passenger compartment in the area of the door opening, wherein the sensor unit is configured for scanning distances, shapes, and movements of objects, wherein the sensor unit determines speed and direction in which objects move, and at least one communication element configured for automatically issuing context-based communication with passengers on the basis of readings from the sensor unit.

2. The door system according to claim 1, wherein the sensor unit measures distances based on a transmitted point cloud in which the delay of a reflection of a pulse is evaluated.

3. The door system according to claim 1, wherein the sensor unit comprises an optical sensor.

4. The door system according to claim 2, wherein the sensor unit comprises an evaluation unit.

5. The door system according to claim 2, wherein the sensor unit comprises a laser scanner unit.

6. The door system according to claim 1, wherein the passenger compartment comprises an interior space of the vehicle or an exterior space outside the vehicle.

7. The door system according to claim 1, wherein two door wings are present, and the sensor unit monitors a space between the main closing edges of the two door wings.

8. The door system according to claim 1, wherein the sensor unit is designed and oriented such that in addition, outside the vehicle a space is scanned which extends up to 5 m from the door opening.

9. The door system according to claim 1, wherein a space through which the door or the door wings move, is monitored by the sensor unit to prevent injury, whereby the opening movement of the door or the door wing is interrupted when there is an obstacle in that space.

10. The door system according to claim 1, wherein the communication element is designed as speakers in the door area.

11. The door system according to claim 1, wherein the communication element is designed as monitor in the door area.

12. The door system according to claim 1, wherein the communication element is designed as lights in the door area.

13. A process for monitoring and control of a door systems of a public transit vehicle, the process including the following steps:

touch-free and three-dimensional scanning of a passenger compartment in the area of a door opening with a sensor unit, measuring distances, shapes, and movements of objects by evaluating the readings of the touch-free and three-dimensional scanning, determining speed and direction in which objects move, and automatically issuing by the door system at least one context-based information to affected passengers via a communications system, whereby the information is based on readings from the sensor unit.

14. The process according to claim 13, wherein boarding and de-boarding passengers are determined and counted, and information is given to passengers that is based on the rate at which the vehicle is being filled.

15. The process according to claim 13, wherein the sensor unit scans a boarding aid whereby, when obstacles such as a layer of snow or ice are determined, an appropriate information is given to the passengers.

16. The process according to claim 13, wherein the sensor unit determines whether an object or a passenger is leaning against a door or a door wing while the door or the door wing is to remain closed and whether an appropriate message should be sent to the passenger while the door or the door wing remains closed until the potential danger is removed.

17. The process according to claim 13, wherein the sensor unit determines whether an object, or particularly a passenger, is standing too closely to the door or a door wing while the door or the door wing is to be opened and whether an appropriate message should be sent to the passenger while the door or the door wing remains closed until the potential danger is removed.

18. The process according to claim 13, wherein the sensor unit determines whether passengers are moving towards a door marked as defective and whether it is necessary to send the passengers an appropriate message.

19. The process according to claim 13, wherein the sensor unit determines, whether passengers are preventing the closing of a door by standing to close to the door and whether an appropriate information is already being sent to the passengers prior to the door closing.

20. The process according to claim 13, wherein the sensor unit determines whether passengers have a bicycle with them; and that it is checked whether there is room for the bicycle in this car, and if not, the passengers are told whether there might be room in another car.

* * * * *